US007730580B2

(12) United States Patent
Mokashi et al.

(10) Patent No.: US 7,730,580 B2
(45) Date of Patent: Jun. 8, 2010

(54) AUTOMOBILE VEHICLE STRIKER ASSEMBLY

(75) Inventors: Girishsingh A. Mokashi, Sterling Heights, MI (US); Gary L. Schubring, Chesterfield, MI (US)

(73) Assignee: Newfrey LLC, Newark, DE (US)

( * ) Notice: Subject to any disclaimer, the term of this patent is extended or adjusted under 35 U.S.C. 154(b) by 533 days.

(21) Appl. No.: 11/415,458

(22) Filed: May 1, 2006

(65) Prior Publication Data

US 2006/0242789 A1 Nov. 2, 2006

Related U.S. Application Data

(63) Continuation-in-part of application No. 29/229,039, filed on May 2, 2005, now Pat. No. Des. 534,056.

(51) Int. Cl.
*E05F 5/00* (2006.01)

(52) U.S. Cl. ..... 16/86 R

(58) Field of Classification Search ..... 16/86 R, 16/82, 85, 86 A, 86 B; 296/207; 292/340, 292/341.11, 341.12, 341.13, 341.18
See application file for complete search history.

(56) References Cited

U.S. PATENT DOCUMENTS

| | | | | | |
|---|---|---|---|---|---|
| 1,467,782 | A | * | 9/1923 | Englund | 292/15 |
| 2,024,887 | A | | 12/1935 | Schonitzer | |
| 2,075,820 | A | * | 4/1937 | McKinney | 292/341.12 |
| 2,100,591 | A | * | 11/1937 | Haberstump | 292/302 |
| 2,187,531 | A | * | 1/1940 | Butler | 16/85 |
| 2,217,892 | A | | 10/1940 | Dodge | |
| 3,008,174 | A | * | 11/1961 | Schonitzer | 16/85 |
| 3,552,791 | A | * | 1/1971 | Watermann | 292/340 |
| 4,178,658 | A | | 12/1979 | Gergonne | |
| 4,413,374 | A | * | 11/1983 | Ferdinand et al. | 16/441 |
| 4,683,917 | A | * | 8/1987 | Bartholomew | 138/121 |
| 5,060,900 | A | * | 10/1991 | Kokoruda et al. | 248/311.2 |
| 5,269,538 | A | | 12/1993 | Strang | |
| 6,099,054 | A | * | 8/2000 | Glass et al. | 292/340 |
| 6,349,989 | B1 | | 2/2002 | Kim | |
| 6,676,201 | B2 | | 1/2004 | Im et al. | |
| 6,692,046 | B2 | | 2/2004 | Paskonis | |
| 7,014,258 | B2 | * | 3/2006 | Schubring et al. | 296/207 |
| 7,308,731 | B2 | * | 12/2007 | Schubring et al. | 16/86 R |
| 2005/0060867 | A1 | | 3/2005 | Schubring et al. | |
| 2006/0097550 | A1 | * | 5/2006 | Wang et al. | 296/207 |
| 2006/0200939 | A1 | * | 9/2006 | Schubring et al. | 16/86 R |

* cited by examiner

*Primary Examiner*—Victor Batson
*Assistant Examiner*—Matthew Sullivan
(74) *Attorney, Agent, or Firm*—Harness, Dickey & Pierce, P.L.C.

(57) ABSTRACT

A striker used between a vehicle component and a vehicle body member includes a homogenous polymeric striker body. The body includes a first portion having opposed first and second sides, and a raised mid-body between the first and second sides. A second portion is oriented at an angle with respect to the first portion. The second portion includes first and second mounting wings and a bumper receiving portion positioned between the mounting wings. A resilient bumper is engaged with the second portion extending partially over the inclined surface. The raised mid-body defines a substantially planar, inclined surface continuously increasing in elevation with respect to the first and second sides between a first portion free end and a first and second portion intersection. The second portion has at least one rectangular-shaped cavity created on a vehicle body engaging side adapted to non-rotatably receive a geometrically configured fastener.

15 Claims, 6 Drawing Sheets

AUTOMOBILE VEHICLE STRIKER ASSEMBLY

CROSS-REFERENCE TO RELATED APPLICATIONS

This application is a continuation-in-part of U.S. Design application Ser. No. 29/229,039, filed on May 2, 2005, which is incorporated herein by reference.

FIELD

The present disclosure relates to vehicle door displacement limiting systems and more specifically to a device and method of assembly for automobile door striker systems.

BACKGROUND

The statements in this section merely provide background information related to the present disclosure and may not constitute prior art.

Vehicles including automobile sport utility vehicles, station wagons, mini-vans, cross-over vehicles, cargo vans and trucks often provide an access door, commonly known as a lift-gate door. Other similar door designs include hatchback doors, sliding doors and horizontally swinging doors. Although these door designs can be mounted differently, for simplicity, these door designs will hereinafter be summarized in reference to lift-gate doors. Lift-gate doors are frequently hinged along an upper horizontal surface, and latch adjacent to a flooring system of the automobile, commonly adjacent to the rear fender of the automobile. One or more latches can be used. The side edges of lift-gate doors are generally not hinged or physically connected to the vehicle structure or support posts at the rear of the vehicle. Motion of the vehicle therefore can result in "match-boxing", or non-parallel deflection of the support posts relative to the squared sides of the lift-gate door. Match-boxing is undesirable for several reasons. First, side-to-side or non-parallel motion of support posts can impart additional vehicle noise, known as "chucking" at the lift-gate latch as the vehicle travels along rough or uneven surfaces. Second, unless a mechanism is positioned between the lift-gate door edge and the support posts of the vehicle, full structural allowance for the stiffness of the lift-gate cannot be used in the design of the support structure area.

In order to include the stiffness of the lift-gate door in the analysis and design of structural support posts, wedge type fittings have been used which slide to span the gap between the lift-gate door and the support post. These fittings reduce match-box deflection of the support posts by transferring some deflection load to the lift-gate door using a sliding wedge mechanism generally positioned between each support post and the lift-gate door. The sliding wedge mechanism can be fastened to either or both edges of the lift-gate door or to an edge of one or both of the support posts. In a further known design, a free sliding displaceable wedge is positioned against each lift-gate door side edge and a striker plate is separately mounted to each support post such that the sliding wedge engages the striker plate and displaces relative to the lift gate door to limit match-boxing between the support posts.

Existing designs of polymeric striker assemblies have several drawbacks. When molded, part cooling often results in shrinkage which distorts the striker and prevents proper engagement between the striker and the vehicle component. In some applications, existing fittings are present, which require removal of material of the striker to avoid. This increases mold cost and can decrease part strength. Existing striker designs may also not accommodate sufficient clearance to allow the opposed wedge assembly to freely clear the striker during travel of the lift gate door when wedge engagement is not desirable.

SUMMARY

According to several embodiments of an automobile vehicle striker assembly of the present disclosure, a vehicle striker for use between a vehicle opening/closing component and a vehicle body member provides a homogenous polymeric striker body. A first body portion has opposed first and second sides and an inclined surface positioned between the first and second sides. A second body portion is created at an angle with respect to the first body portion. The second body portion has at least one rectangular-shaped cavity created on a vehicle body engaging side adapted to non-rotatably receive a geometrically configured fastener. A resilient bumper is engaged with the second body portion and extends partially over the inclined surface.

According to several further embodiments, a vehicle striker for use between a vehicle opening/closing component and a vehicle body member includes a homogenous polymeric striker body. A first body portion includes opposed first and second sides, and a raised mid-body positioned between the first and second sides. A second body portion oriented at an angle with respect to the first body portion includes first and second mounting wings and a bumper receiving portion positioned between the first and second mounting wings. A resilient bumper is engaged with the second body portion and extends freely and partially over the inclined surface. The raised mid-body defines a substantially planar, inclined surface continuously increasing in elevation with respect to the first and second sides between a free end of the first body portion and an intersection of the first and second body portions.

According to still further embodiments, a method for creating a vehicle striker for use between a vehicle opening/closing component including a homogenous polymeric striker body having a first body portion having opposed first and second sides, and a vehicle body member includes co-molding a raised mid-body between the first and second sides defining a substantially planar inclined surface. In an additional step, the method includes orienting a second body portion at an angle with respect to the first body portion. The method also includes creating first and second mounting wings and a bumper receiving portion between the first and second mounting wings of the second body portion. The method still further includes engaging a resilient bumper with the second body portion, the resilient bumper extending freely and partially over the inclined surface. The method yet further includes continuously increasing an elevation of the inclined surface of the raised mid body with respect to the first and second sides between a free end of the first body portion and an intersection of the first and second body portions.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
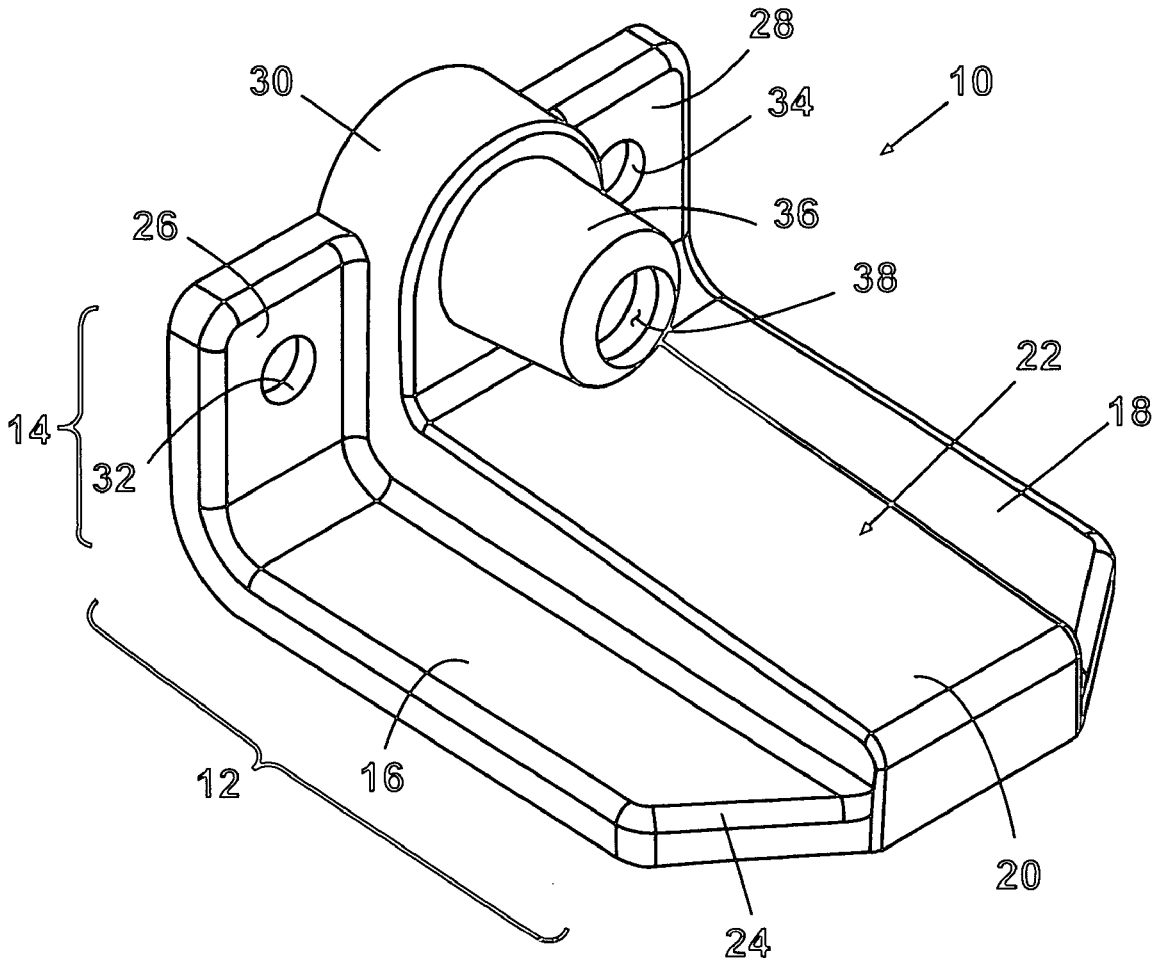
FIG. 1 is a perspective view of an automobile vehicle striker assembly of the present disclosure.

The following description is merely exemplary in nature and is not intended to limit the present disclosure, application, or uses. It should be understood that throughout the drawings, corresponding reference numerals indicate like or corresponding parts and features.

According to several embodiments of the present disclosure and referring generally to FIG. 1, a striker 10 created by molding a polymeric material includes a first body portion 12 and a second body portion 14 homogenously joined and defining an angle with respect to first body portion 12. First body portion 12 further includes a first body side 16, a second body side 18, and a raised mid-body 20 positioned between and elevated above each of the first and second body sides 16, 18. Raised mid-body 20 includes an inclined surface 22. A surface finish of inclined surface 22 is predefined to promote a sliding action of contact between inclined surface 22 and an oppositely positioned vehicle contact member (shown and described in reference to FIG. 6) for example when a vehicle door is closed. Each of the first and second body sides 16, 18 and raised mid-body 20 have a rounded edge 24 at the perimeter of these elements.

Second body portion 14 includes a first mounting wing 26 and a second mounting wing 28 having a bumper receiving portion 30 positioned between each of the first and second mounting wings 26, 28. A first fastener aperture 32 is created in first mounting wing 26 and a second fastener aperture 34 is similarly created in second mounting wing 28. First and second fastener apertures 32, 34 are each adapted to receive a fastener used to fastenably engage striker 10 to a vehicle body. A resilient bumper 36 created of a resilient material which in several embodiments is rubber is retained on bumper receiving portion 30. Resilient bumper 36 can include a hollow cavity 38 in several embodiments which allows resilient bumper 36 to more easily deflect. With the exception of resilient bumper 36, the material of striker 10 in several embodiments is a polymeric material such as a glass filled polyamide 6-6 material which can be created using a molding operation such as injection molding.

Figure 2:
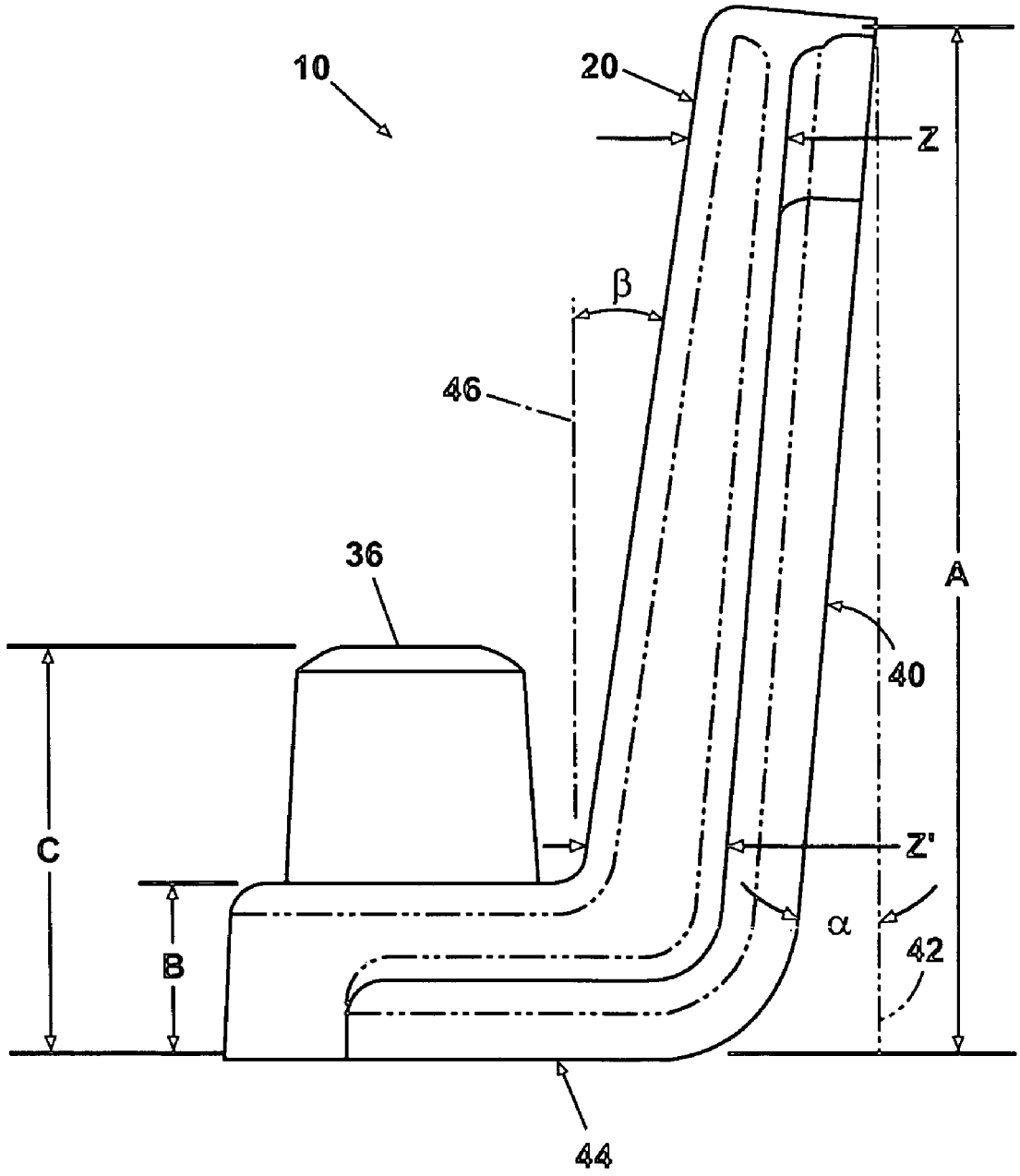
FIG. 2 is a side elevational view of the striker assembly of FIG. 1.

As best seen in reference to FIG. 2, first body portion 12 includes a first mounting surface 40. First mounting surface 40 defines a body offset angle $\alpha$ with respect to an axis 42 which is oriented substantially perpendicular to a second mounting surface 44 created on second body portion 14. First body portion 12 further includes a body portion length "A" which in several embodiments is approximately 82.8 mm.

Inclined surface 22 of raised mid-body 20 defines an included surface angle $\beta$ with respect to a reference axis 46. In several embodiments, included surface angle $\beta$ is approximately 5 degrees. Inclined surface 22 continuously increases in height from a first free end (height Z) of first body portion 12 to the intersection of first and second body portions 12 and 14 (height Z'). Reference axis 46, similar to axis 42, is substantially perpendicular to second mounting surface 44. Second body portion 14 has a second body portion thickness "B" which in several embodiments is approximately 14.0 mm. Resilient bumper 36 positioned on second body portion 14 defines a total bumper stand-off height "C" which in several embodiments is approximately 32.9 mm.

Figure 3:
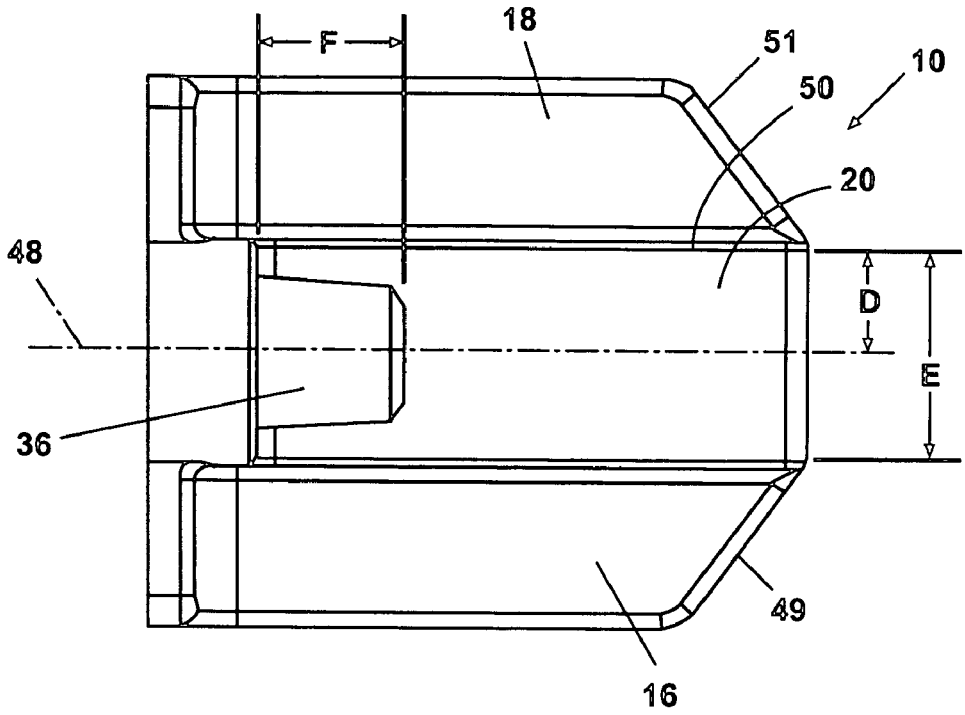
FIG. 3 is a top plan view of the striker assembly of FIG. 1.

Referring now to FIG. 3, raised mid-body 20 is substantially bisected by a body longitudinal axis 48. In several embodiments, a reference dimension "D" of approximately 15 mm is defined between body longitudinal axis 48 and a mid-body edge 50. A mid-body width "E" is therefore substantially equal to 30 mm in several embodiments of the present disclosure. A bumper length "F" is approximately 18.9 mm. Each of the first and second body sides 16, 18 can also include a first tapered end face 49 and a second tapered end face 51 respectively.

Figure 4:
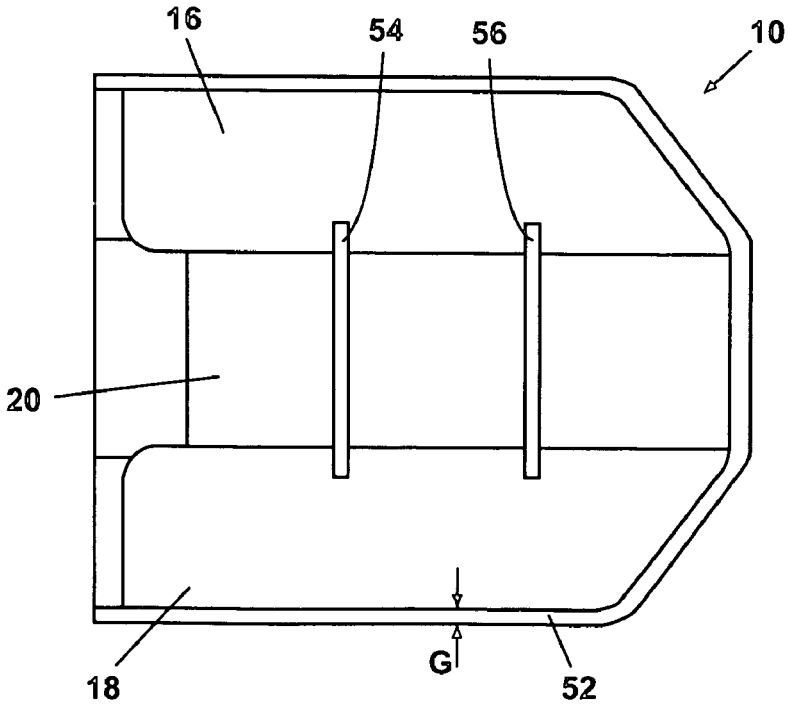
FIG. 4 is a bottom plan view of the striker assembly of FIG. 1.

Referring now in general to FIG. 4, an underside of first body portion 12 of striker 10 defines a body outer wall 52 peripherally created about each of first and second body sides 16, 18 and raised mid-body 20. Body outer wall 52 has a wall thickness "G" which can vary at the discretion of the manufacturer. In order to further stiffen striker 10 at least one and in several embodiments a plurality of stiffener ribs are co-molded with striker 10 which span between the first and second body sides 16, 18 and homogenously extend from the undersurface of raised mid body 20. According to several embodiments, a first stiffener rib 54 and a second stiffener rib 56 are provided, however, as few as one or more than two stiffener ribs can also be used without departing from the scope of the present disclosure.

Figure 5:
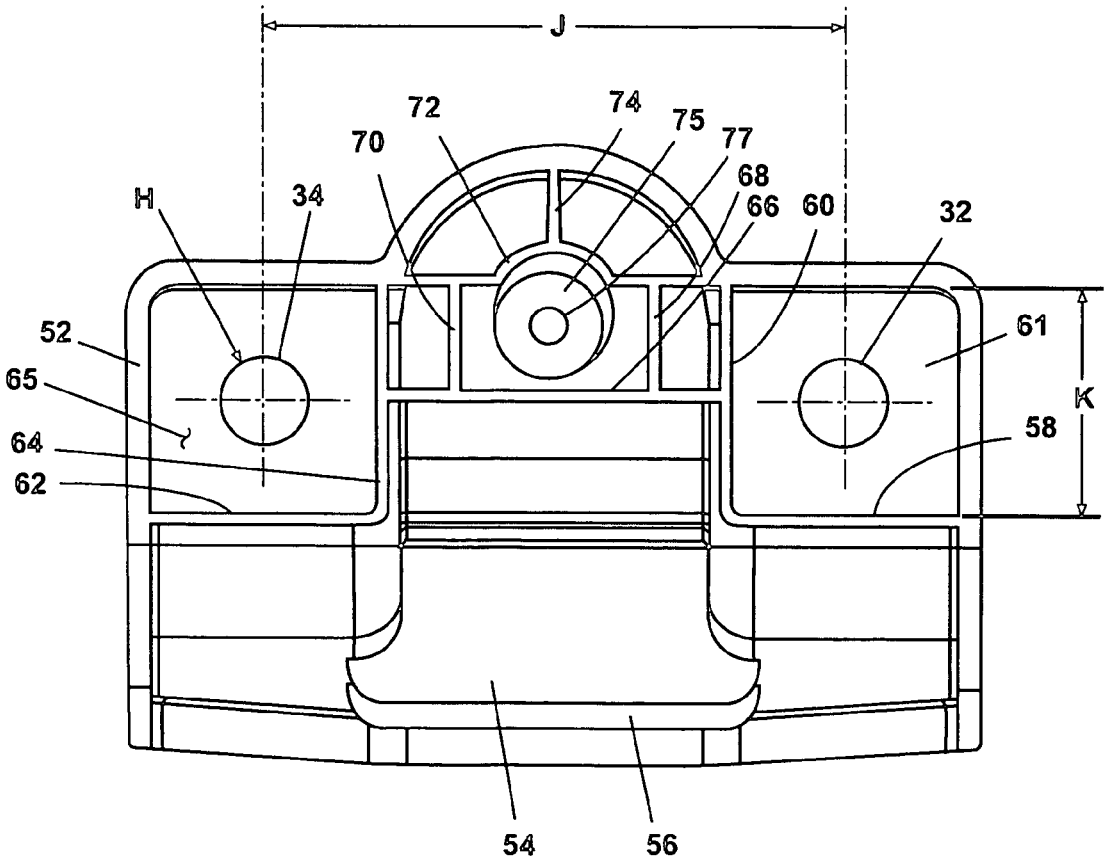
FIG. 5 is a rear elevational view of the striker assembly of FIG. 1.

Referring now to FIG. 5, a vehicle engaging side or second mounting surface 44 of second body portion 14 includes body outer wall 52 and a plurality of inner walls, cross brace walls, and intermediate walls which collectively define second mounting surface 44. These include a first inner wall 58 and a second inner wall 60 which define, together with a portion of body outer wall 52, a first rectangular cavity 61. Similarly, a third inner wall 62 and a fourth inner wall 64 combined with another portion of body outer wall 52 define a second rectangular cavity 65. First and second rectangular cavities 61 and 65 have each of first and second fastener apertures 32, 34 created substantially in the center of each of the cavities. First and second rectangular cavities 61, 65 are created to non-rotatably engage the outer opposed engagement faces of a nut or similar fastener (shown and described in reference to FIG. 6) which allow a hands free installation of striker 10 over a vehicle body surface using the nuts.

An aperture spacing "J" defines the location of each of the first and second fastener apertures 32, 34. According to several embodiments of the present disclosure aperture spacing "J" is approximately 49.0 mm. A cavity width "K" is therefore controlled when each of first, second, third and fourth inner walls 58, 60, 62, 64 are created in the mold or die used to create striker 10 to coincide with the dimension across the flats of the associated nut or fastener. A cross-brace wall 66 can be used to span the otherwise significantly hollow rear portion of bumper receiving portion 30. In addition to cross-brace wall 66, a first intermediate wall 68, a second intermediate wall 70, a curved wall 72, and a third intermediate wall 74 can also be used to stiffen the proximate area of bumper receiving portion 30 where a bumper retention element 75 of resilient bumper 36 is engaged within an aperture 77 created in bumper receiving portion 30. The relative sizes and locations of each of first and second stiffener ribs 54, 56 are also visible in FIG. 5.

Figure 6:
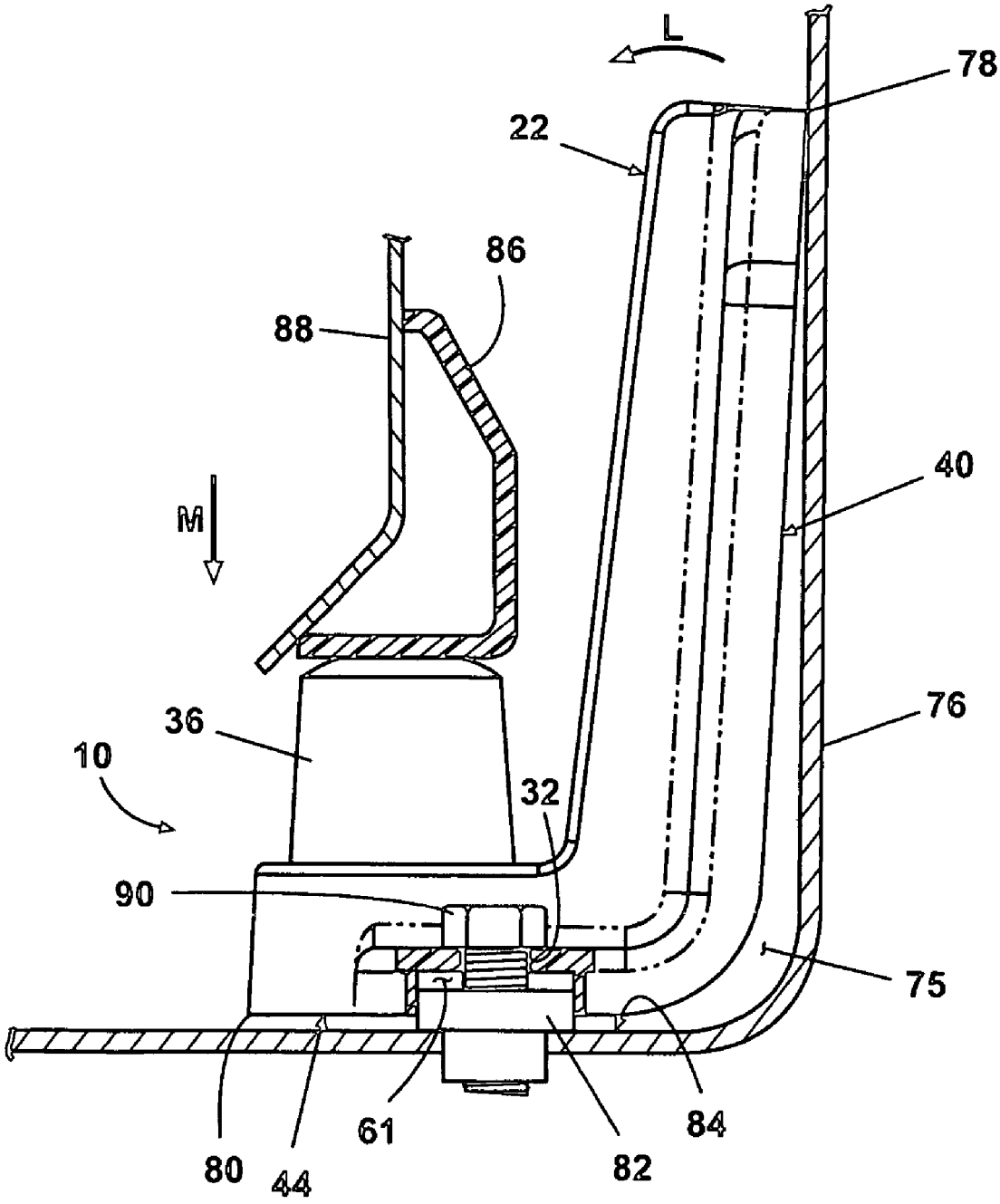
FIG. 6 is a side elevational view similar to FIG. 2, further showing a vehicle panel prior to installation of the striker assembly.

Referring now generally to FIG. 6, body offset angle α is predefined in striker 10 in order to ensure that both first and second body portions 12 and 14 of striker 10 will engage in a substantially 90 degree walled cavity 75 created in a vehicle panel 76, allowing for dimensional tolerances of both striker 10 and vehicle panel 76. According to several embodiments of the present disclosure, body offset angle α is approximately 30 (within a range including 10 to 50). Angle α allows for normal shrinkage of striker 10 as the part cools following the molding process, and promotes complete contact of first and second mounting surfaces 40, 44 with vehicle panel 76. Angle α also ensures contact between striker 10 and vehicle panel 76 at least between a first contact point 78 defining a first free end of first mounting surface 40 and a second contact point 80 defining a second free end of second mounting surface 44 when maximum tolerances are reached for striker 10 and the receiving surface of vehicle panel 76. A limited deflection of first body portion 12 with respect to second body portion 14 can also occur in a deflection path "L" after each of first and second contact points 78, 80 have contacted the substantially 90 degree walled surfaces of cavity 75 of vehicle panel 76. This limited deflection promotes complete contact of first and second mounting surfaces 40 and 44 with vehicle panel 76.

In the exemplary installation shown in FIG. 6, a nut 82 is pre-positioned by insertion through a preformed aperture in vehicle panel 76 from a contact surface 84 side of vehicle panel 76. Nut 82 is non-rotatably engaged within first rectangular cavity 61 of first body portion 12 when striker 10 is fastenably connected to vehicle panel 76. Thereafter, a vehicle contact member 86 connected to a vehicle component 88 can abut resilient bumper 36. Vehicle contact member 86 translates in a first direction "M" to engage resilient bumper 36 which minimizes "match-boxing" and/or "chucking". In several embodiments vehicle component 88 can be a metal plate of a lift gate door or a support post. In several embodiments, striker 10 and vehicle contact member 86 are created of a polymeric material such as a glass (such as fiberglass) filled polyamide 6-6 and vehicle contact member 86 is also fixed such as by fastening to vehicle component 88. In several embodiments, the polyamide material of striker 10 and vehicle contact member 86 have approximately a 13% glass content, to permit a degree of part flexibility. A fastener 90 such as a threaded or thread cutting screw can be inserted through both first and second apertures 32, 34 (only first aperture 32 is visible in this view) engaging nut 82 to fastenably connect striker 10 to vehicle panel 76 in first direction "M".

Figure 7:
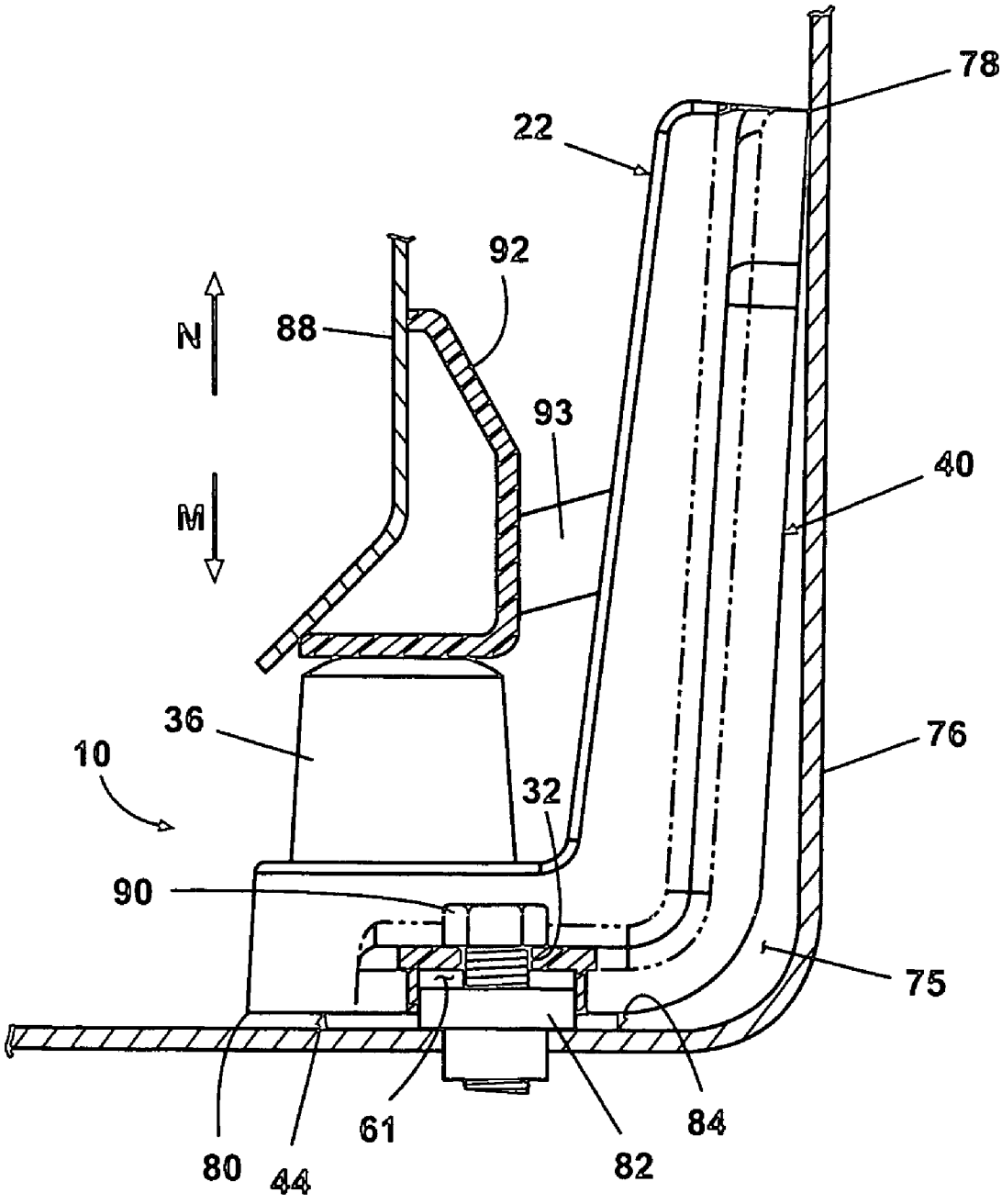
FIG. 7 is a side elevational view similar to FIG. 6, further showing an additional embodiment of a vehicle contact member having a sliding wedge in use with the striker assembly of FIG. 1.

Referring now generally to FIG. 7, in several embodiments a second vehicle contact member 92 is used in place of vehicle contact member 86. Vehicle contact member 92 at least partially compresses resilient bumper 36 similarly to vehicle contact member 86, and can further include a sliding wedge 93 which can displace in either first direction "M" or an opposite second direction "N". Sliding wedge 93 moves in sliding contact with inclined surface 22 to further minimize "match-boxing" and/or "chucking". Vehicle contact member 92 is also a polymeric material similar to vehicle contact member 86 and can be fastenably connected to vehicle component 88.

A striker 10 of the present disclosure offers several advantages. By incorporating rectangular-shaped cavities in a vehicle engaging side of second body portion 14, nuts or similar fasteners can be non-rotatably engaged which allows a blind installation of striker 10 with respect to the nuts. A blind installation (the installer places the striker over the nuts and the nuts are freely received in the striker without visual reference to the nuts) is made possible because the orientation of the nuts is pre-determined by a correspondingly rectangular-shaped aperture in the vehicle panel. The use of body offset angle α allows striker 10 to engage a substantially 90 degree body or lift gate door panel junction allowing for manufacturing tolerances including part shrinkage of striker 10 and configuration/stamping tolerances of the body or lift gate door panel junction area.

What is claimed is:

1. A vehicle striker for use between a vehicle opening/closing component and a vehicle body member, comprising:
- a one-piece polymeric striker body including:
  - a first body portion having first and second sides, a raised mid-body positioned between the first and second sides having an inclined surface inclined with respect to the first and second sides, and at least one stiffener rib homogeneously connected to the first and second body sides and spanning the raised mid-body and extending from a vehicle body first mounting surface of the first body portion oppositely facing with respect to the inclined surface; and
  - a second body portion oriented at an angle with respect to the first body portion, the second body portion having a vehicle body member second mounting surface including a body outer wall and inner walls which collectively define the second mounting surface, the inner walls including a first inner wall and a second inner wall which define, together with a portion of the body outer wall, a first rectangular cavity, and a third inner wall and a fourth inner wall which define, together with another portion of the body outer wall a second rectangular cavity; and
- the first and second rectangular cavities each including one of a first and a second fastener aperture created substantially in a center of the first and second rectangular cavities, the first and second rectangular cavities created to non-rotatably engage outer opposed engagement faces of the first and second nuts.

2. The vehicle striker of claim 1, wherein the second body portion further comprises a bumper receiving portion having an aperture adapted to receive a resilient bumper.

3. The vehicle striker of claim 2, wherein the second mounting surface of the second body portion is oppositely facing with respect to the bumper receiving portion.

4. The vehicle striker of claim 2, wherein the vehicle body first mounting surface is oriented at a body offset angle with respect to an axis defined substantially perpendicular to the second mounting surface.

5. The vehicle striker of claim 4, wherein the body offset angle comprises substantially 3 degrees.

6. The vehicle striker of claim 2, wherein the bumper further comprises a rubber material.

7. The vehicle striker of claim 2, wherein the bumper includes an extending portion adapted to be received and engaged within the aperture created in the bumper receiving portion.

8. A vehicle striker for use between a vehicle opening/closing component and a vehicle body member, comprising:
- a homogenous polymeric striker body including:
  - a first body portion including:
    - opposed first and second sides; and
    - a raised mid-body positioned between the first and second sides, the raised mid-body connected to the first and second sides extensive of the first and second sides using opposed mid body edges such that an inclined surface of the raised mid-body continuously increases in height from a first free end height to a second free end height measured from the inclined surface with respect to the first and second body sides at an intersection of the mid body edges with the first and second body sides; and a second body portion oriented at an angle with respect to the first body portion, the second body portion including first and second mounting wings each having one of a first and second fastener aperture each aligned with one of a first and a second rectangular cavity, and a bumper receiving portion positioned between the first and second mounting wings; and a resilient bumper engaged with the second body portion and extending freely and partially over the inclined surface;

wherein the raised mid-body defines a substantially planar, inclined surface continuously increasing in elevation with respect to the first and second sides between a free end of the first body portion and an intersection of the first and second body portions.

9. The vehicle striker of claim 8, wherein the first and second rectangular-shaped cavities are created on a second vehicle body engaging side adapted to non-rotatably receive one of the first and second nuts when the second vehicle body engaging side is oriented toward the vehicle body member.

10. The vehicle striker of claim 9, wherein the bumper receiving portion is elevated with respect to both the first and second mounting wings.

11. The vehicle striker of claim 9, wherein each of the first and second rectangular shaped cavities is defined by:

a body outer wall portion of the second body portion;

a first inner wall homogenously extending from the second body portion; and a second inner wall homogenously extending from the second body portion and oriented substantially perpendicular to the first inner wall.

12. The vehicle striker of claim 9, further comprising at least one stiffening rib homogenously extending from the vehicle body engaging side and each of the opposed first and second sides and the raised mid-body.

13. The vehicle striker of claim 8, wherein the vehicle body engaging side further comprises:

a first body mounting surface of the first body portion oppositely facing with respect to the inclined surface; and a second body mounting surface of the second body portion oppositely facing with respect to the bumper receiving portion.

14. The vehicle striker of claim 13, wherein the first body mounting surface is oriented at a body offset angle with respect to an axis defined substantially perpendicular to the second body mounting surface.

15. The vehicle striker of claim 13, wherein the inclined surface defines an inclined surface angle of approximately 5 degrees with respect to an axis defined substantially perpendicular to the second body mounting surface.

* * * * *

UNITED STATES PATENT AND TRADEMARK OFFICE

CERTIFICATE OF CORRECTION

PATENT NO. : 7,730,580 B2
APPLICATION NO. : 11/415458
DATED : June 8, 2010
INVENTOR(S) : Girishsingh A. Mokashi et al.

It is certified that error appears in the above-identified patent and that said Letters Patent is hereby corrected as shown below:

Column 6,
Line 3, after "cavity;" insert the following paragraph:

-- a spacing between the first and second fastener apertures and the first and second rectangular cavities configured to align the first and second apertures with a first nut and a second nut both premounted on the vehicle body member; --.

Column 7,
Line 23, "portions." should be -- portions; --.

Between lines 23 and 24, insert the following paragraph:

-- a spacing between the first and second fastener apertures and the first and second rectangular cavities configured to align the first and second apertures with a first nut and a second nut both premounted on the vehicle body member. --.

Signed and Sealed this

Twentieth Day of July, 2010

David J. Kappos

David J. Kappos
*Director of the United States Patent and Trademark Office*